US007810805B2

(12) United States Patent
Suzuki

(10) Patent No.: US 7,810,805 B2
(45) Date of Patent: Oct. 12, 2010

(54) SHEET DISCHARGING APPARATUS AND IMAGE FORMING APPARATUS

(75) Inventor: Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/361,820

(22) Filed: Jan. 29, 2009

(65) Prior Publication Data

US 2009/0189344 A1 Jul. 30, 2009

(30) Foreign Application Priority Data

Jan. 30, 2008 (JP) ..... 2008-018723
Jan. 20, 2009 (JP) ..... 2009-009897

(51) Int. Cl.
*B65H 31/00* (2006.01)
*B65H 31/26* (2006.01)

(52) U.S. Cl. ..... 271/207; 271/220

(58) Field of Classification Search ..... 271/207, 271/220, 314
See application file for complete search history.

(56) References Cited

U.S. PATENT DOCUMENTS 4,575,069 A * 3/1986 Burkhart ..... 271/186
5,524,877 A * 6/1996 Weber et al. ..... 271/220
6,666,603 B1 12/2003 Suzuki et al.
7,407,160 B2 * 8/2008 Peulen et al. ..... 271/207
7,648,137 B2 * 1/2010 Ogashiwa ..... 271/207
2003/0160385 A1 * 8/2003 Furusawa ..... 271/220
2006/0237900 A1 * 10/2006 Sekiyama et al. ..... 271/220
2007/0063427 A1 * 3/2007 Hong ..... 271/220
2007/0069454 A1 * 3/2007 Ino ..... 271/220

FOREIGN PATENT DOCUMENTS

JP 9-48558 A 2/1997
JP 2003-246535 A 9/2003

* cited by examiner

*Primary Examiner*—David H Bollinger
(74) *Attorney, Agent, or Firm*—Fitzpatrick, Cella, Harper & Scinto

(57) ABSTRACT

There is provided a sheet discharging apparatus and an image forming apparatus, in which even a curled sheet can properly be discharged to and stacked on a sheet stacking portion. A projection is provided in a central portion in a width direction of a tailing end regulating portion while projected toward an upstream side in a sheet discharge direction. The tailing end regulating portion regulates a tailing end position of the sheet stacked on the sheet stacking portion. The tailing end position of the sheet discharged to the sheet stacking portion is supported by the projection, and the both end portions in the width direction of the sheet are pushed down below an upper surface of the projection by pressing portions at both ends of a full load detecting flag, thereby bending the sheet.

21 Claims, 18 Drawing Sheets

SHEET DISCHARGING APPARATUS AND IMAGE FORMING APPARATUS

BACKGROUND OF THE INVENTION

1. Field of the Invention

The present invention relates to a sheet discharging apparatus and an image forming apparatus, particularly to the sheet discharging apparatus and image forming apparatus provided with a pressing member which presses sheets stacked in a sheet stacking portion from above.

2. Description of the Related Art

Conventionally, an image forming apparatus, such as a printer, a facsimile, a copying machine, and a multi function printer, which includes a sheet discharging apparatus. The sheet discharging apparatus discharges a sheet in which an image is formed to a sheet discharge portion and stacks the sheet on a sheet stacking portion provided below the sheet discharge portion.

In the image forming apparatus, when the image is formed in the sheet, a photosensitive drum whose surface is charged in a predetermined polarity is irradiated with light based on image information, thereby forming an electrostatic latent image on a surface of the photosensitive drum.

A development device supplies toner charged in the same polarity as the photosensitive drum to the photosensitive drum on which the electrostatic latent image is formed, and the toner is adsorbed to a portion of the photosensitive drum in which the charge does not exist, thereby developing the electrostatic latent image. Then a conveying portion including a sheet feeding roller and a conveying roller conveys a sheet to which the toner image is transferred to a nip portion between the photosensitive drum and a transfer roller. When the transfer roller applies charges having an opposite-polarity to the toner to the backside of the sheet, and the toner on the surface of the photosensitive drum is attracted onto the sheet.

Then the sheet to which the toner image is already transferred is conveyed to a nip portion of a fixing portion. The nip portion of the fixing portion is formed by a heating roller into which a heating device is incorporated and a pressure roller that pressure-contacts the heating roller. The fixing portion heats and pressurizes the sheet to fix the toner image to the sheet. The sheet to which the toner image is already fixed is discharged from a sheet discharge port to a sheet stacking portion by a pair of discharge rollers provided in the sheet discharging apparatus. In order to secure alignment performance, the sheet stacking portion is upwardly inclined toward a downstream side in a sheet discharge direction.

In the case where the sheet is heated by the fixing portion, because a difference in sheet shrinkage amount is generated between the heating roller side and the pressure roller side, a curl (warp, curvature) is generated in the sheet discharged to the sheet stacking portion. When the curl is generated, a sheet stacking property is deteriorated in the sheet stacking portion.

The curl tends to be prominently generated in a high-temperature, high-humidity environment when the sheet has a large amount of water absorption. Therefore, in a conventional sheet discharging apparatus, a pressing member is provided above the sheet discharge port in order to improve the sheet stacking property. The pressing member presses a neighborhood of a tailing end of the sheet stacked on the sheet stacking portion from above to suppress the curl of the sheet.

Conventionally, the sheet has a feature that the sheet is easily stretched and contracted in a direction parallel to a fiber array (paper making grain) direction. That is, the curl direction depends on the fiber array (long grain and short grain) direction of the sheet. The sheet having the paper making grain in the same direction as the sheet discharge direction has a curl shape (hereinafter referred to as long grain curl) in which both ends in a direction (hereinafter referred to as width direction) orthogonal to the sheet discharge direction are floated. On the other hand, the sheet having the paper making grain in the width direction has a curl shape (hereinafter referred to as short grain curl) in which a leading end and tailing end in the sheet discharge direction are floated. The sheet is cut such that a long side of the sheet is matched with the long grain direction in many cases.

Usually, the pressing member has a rotational support located above the pair of discharge rollers, and the pressing member is pressed against and lifted by the sheet so as not to obstruct the sheet discharge during discharging the sheet. In other cases, a lower end of the pressing member is located below the nip portion of the pair of discharge rollers in order that the sheet stacked on the sheet stacking portion is not lifted to the nip portion of the pair of discharge rollers.

In the conventional sheet discharging apparatus, when the sheet has the short grain curl, as illustrated in FIG. 18, the sheet end portion that is curled in the sheet discharge direction easily hides in a space between a pair of discharge rollers 200 and a pressing member 201. When a sheet S hides in the space, the pressing member 201 insufficiently exerts a function of pressing the sheet S, and the sheet S blocks a nip of the pair of discharge rollers 200. As a result, sometimes the sheet S blocking the nip of the pair of discharge rollers 200 is damaged, or paper jam is generated in a sheet discharged subsequent to the sheet S.

Conventionally, there is a sheet discharging apparatus in which a fully loaded state (predetermined maximum stacking height) of the sheets stacked on the sheet stacking portion is detected such that the sheet does not block the nip of the pair of discharge rollers, and there is a sheet discharging apparatus in which the pressing member is used to detect the fully loaded state of the sheets. However, when the sheet is curled in the sheet discharge direction, because the pressing member insufficiently exerts the function of pressing the sheet as described above, the fully loaded state of the sheets is hardly detected using the pressing member.

In order to the problem, various configurations are proposed in the conventional sheet discharging apparatus. For example, irregularities are provided in one of the pair of discharge rollers to impart rigidity to the sheet, thereby preventing the floating of the sheet tailing end. A method for early detecting the fully loaded state by downwardly stretching the pressing member and a method for curving the pressing member toward a stacking wall side without stretching the pressing member in order to detect the sheet near the stacking wall are also proposed.

Additionally, for example, Japanese Patent Application Laid-Open No. 2003-246535 proposes a method in which the fully loaded state of the sheets is detected while an upper end of the sheet stacking wall is projected toward the downstream side in the sheet discharge direction to hold the sheet swelling of the tailing end portion. Japanese Patent Application Laid-Open No. 9-48558 also proposes a configuration, in which turnable regulating member is projected from the stacking wall surface side to press the upstream end in the sheet discharge direction each time the sheet is stacked, whereby the breakage of the sheet stacked on the sheet stacking portion can be prevented while the sheet is discharged without catching the sheet.

In the recent image forming apparatus, particularly in the recent full-color laser printer, a demand for a glossy degree (gloss) of the image has been largely increased. However, in the conventional sheet discharging apparatus in which the irregularities are provided in one of the pair of discharge rollers in order to improve the sheet stacking property, the need for the glossy degree cannot be satisfied because uneven gloss or an irregularity trace is generated.

In the method for early detecting the fully loaded state by downwardly stretching the pressing member in order to improve the sheet stacking property, because the fully loaded state of the sheets that are not curled is also detected early, the method is not suitable to the case in which a stacking capacity is ensured in the restricted space. In the method for curving the pressing member toward the stacking wall side without stretching the pressing member in order to detect the sheet near the stacking wall, the discharged sheet is possibly wrapped around the pressing member when colliding with the pressing member.

In the configuration disclosed in Japanese Patent Application Laid-Open No. 2003-246535, because the upper end of the sheet stacking wall is projected toward the downstream side in the sheet discharge direction to hold the sheet swelling of the tailing end portion, the leading end portion of the pressed sheet is moved toward the downstream side in the sheet discharge direction. Therefore, in the case where the configuration disclosed in Japanese Patent Application Laid-Open No. 2003-246535 is applied to the in-apparatus discharge type image forming apparatus, the downstream end in the sheet discharge direction and the lower surface of the image reading apparatus are brought close to each other to collide easily with each other.

Additionally, because the tailing end portion of the sheet is pressed, when the sheet curled in the sheet discharge direction starts the collision with the lower surface of the image reading apparatus, the sheet has nowhere to go, and the physically stranded sheet cannot be prevented from colliding with the sheet. In the configuration disclosed in Japanese Patent Application Laid-Open No. 9-48558, because the turnable regulating member is provided, the control and configuration become complicated to increase cost.

The present invention relates to a sheet discharging apparatus and an image forming apparatus, in which even a curled sheet can properly be discharged to and stacked on a sheet stacking portion.

SUMMARY OF THE INVENTION

The present invention provides a sheet discharging apparatus including a sheet discharge portion which discharges a sheet; a sheet stacking portion on which the sheet discharged from the sheet discharge portion is stacked; a tailing end regulating portion which has a tailing end regulating surface, the tailing end regulating surface regulating an upstream end position in a sheet discharge direction of the sheet stacked on the sheet stacking portion; a pressing member which has pressing portions, the pressing portions pressing the discharged sheet; and a projection which is projected from the tailing end regulating surface toward a downstream side in the sheet discharge direction, the projection being provided between the pressing portions such that an upper surface of the projection locates above a lowest end position of the pressing portion, wherein when an end portion on the upstream side in the sheet discharge direction of the sheet discharged to the sheet stacking portion is supported by the projection, the pressing portions of the pressing member press down the sheet on the both sides of the projection.

According to the present invention, when the end portion on the upstream side in the sheet discharge direction of the discharged sheet is supported by the projection, the sheet are pressed down below the upper surface of the projection by the pressing portions on the both sides of the projection, so that the discharged sheet can be bent. Therefore, even the curled sheet can properly be discharged and stacked on the sheet stacking portion.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings.

Figure 1:
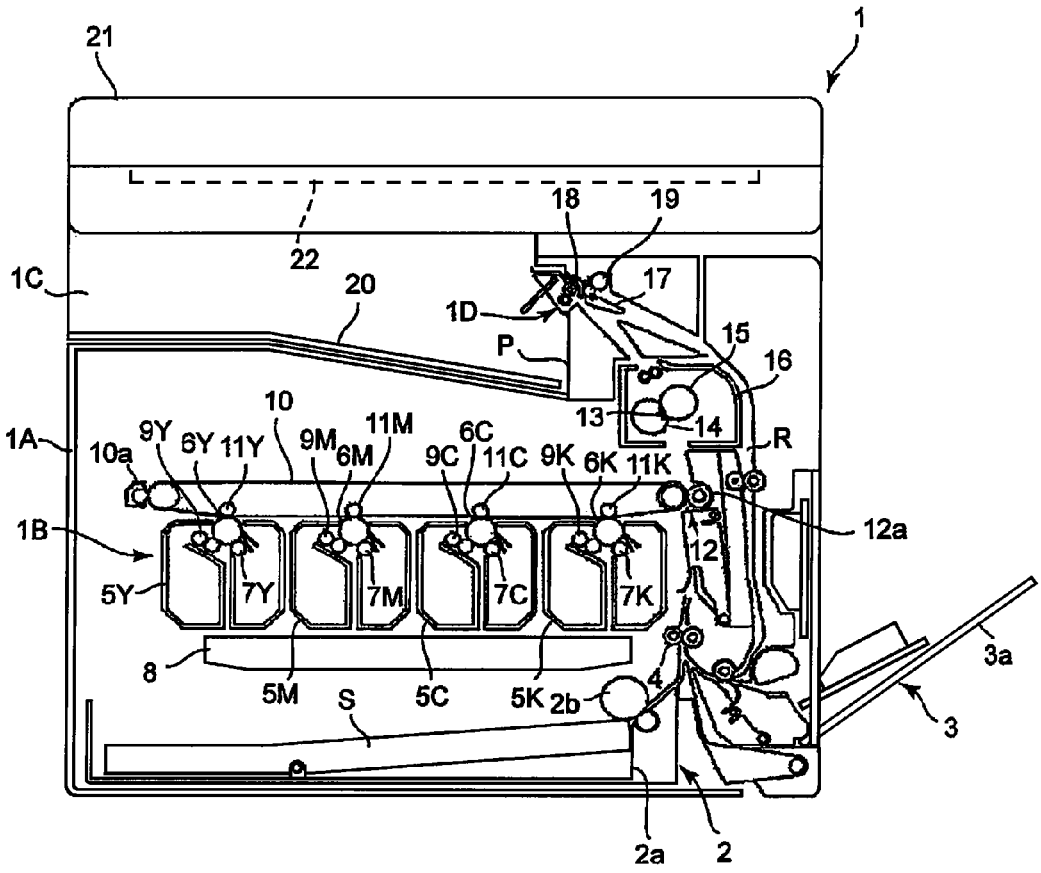
FIG. 1 illustrates an entire configuration of a full-color laser printer which is of an example of an image forming apparatus provided with a sheet discharging apparatus according to a first embodiment of the present invention.

FIG. 1 illustrates an entire configuration of a full-color laser printer which is of an example of an image forming apparatus provided with a sheet discharging apparatus according to a first embodiment of the invention.

Referring to FIG. 1, in a full-color laser printer 1, an image reading apparatus 21 is disposed on a top surface of a full-color laser printer main body (hereinafter referred to as printer main body) 1A. The image reading apparatus 21 reads an image of an original placed on a platen glass 22 which is of an original placing stage. A discharge space portion 1C is provided between the top surface of the printer main body 1A and the image reading apparatus 21. A sheet discharging apparatus 1D discharges the sheet in which the image is formed to the discharge space portion 1C. That is, the full-color laser printer 1 of the first embodiment is the in-apparatus discharge type image forming apparatus.

The printer main body 1A includes an image forming portion 1B that forms the image in the sheet, a sheet feeding portion 2 that feeds the sheet, and a fixing portion 16 that fixes a toner image to the sheet.

The image forming portion 1B includes process cartridges 5 (5Y, 5M, 5C, and 5K) that are detachably attached to the apparatus main body 1A, and the process cartridges 5 (5Y, 5M, 5C, and 5K) include photosensitive drums 6 (6Y, 6M, 6C, and 6K) that respectively form yellow, magenta, cyan, and black toner images. The image forming portion 1B also includes a scanner unit 8 that is disposed directly below the process cartridges 5. The scanner unit 8 irradiates the photosensitive drums 6 with a laser beam to form electrostatic latent images on the photosensitive drums 6 based on image information.

In addition to the photosensitive drums 6, the process cartridges 5 include charging devices 7 (7Y, 7M, 7C, and 7K) that evenly charge surfaces of the photosensitive drums and development devices 9 (9Y, 9M, 9C, and 9K) that cause toners to adhere to the electrostatic latent images to visually form toner images.

Primary transfer rollers 11 (11Y, 11M, 11C, and 11K) are provided inside an intermediate transfer belt 10 while facing the photosensitive drums 6. When the primary transfer rollers 11 apply primary transfer biases to the intermediate transfer belt 10, the toner images on the photosensitive drum are sequentially transferred to the intermediate transfer belt 10, thereby forming a full-color image on the intermediate transfer belt 10.

A secondary transfer portion 12 sequentially transfers the full-color image formed on the intermediate transfer belt 10 to the sheet. A pair of discharge rollers 18 is the sheet discharge portion, and the pair of discharge rollers 18 discharges the sheet in which the image is fixed by a fixing portion 16 to a sheet stacking portion 20 constituting a bottom surface of the discharge space portion 1C.

The fixing portion 16 fixes the toner image by applying heat and pressure onto the image formed on the sheet. The fixing portion 16 includes a heating roller 14 in which a heater 13 is incorporated and a pressure roller 15 that pressure-contacts the heating roller 14.

The sheet feeding portion 2 includes a sheet cassette 2*a* that is detachably attached to the apparatus main body 1A and a pickup roller 2*b*. A manual sheet feeding portion 3 includes a manual sheet feeding tray 3*a* and a manual sheet feeding roller (not illustrated). The sheet discharging apparatus 1D includes the pair of discharge rollers 18.

An image forming operation performed by the full-color laser printer 1 will be described below.

When a control portion (not illustrated) provided in the printer main body 1A supplies an image read signal to an image reading apparatus 21, the image reading apparatus 21 reads the image of the original placed on the platen glass 22. Then the scanner unit 8 irradiates the photosensitive drum with the laser beam corresponding to an electric signal of the read original image.

At this point, the surface of the photosensitive drum 6 is previously evenly charged to a predetermined potential with a predetermined polarity by the charging device 7, the scanner unit 8 irradiates the surface of the photosensitive drum with the laser beam to form an electrostatic latent image in the surface of the photosensitive drum. Then the electrostatic latent image is developed with toner to visualize the image.

For example, first the scanner unit 8 irradiates the photosensitive drum 6Y with the laser beam to form a yellow electrostatic latent image on the photosensitive drum 6Y in response to an image signal of a yellow component color of the original. The yellow electrostatic latent image is developed to visualize the latent image as the yellow toner image using a yellow toner from the development device 9Y.

When the toner image reaches a primary transfer portion in which the photosensitive drum 6Y and the intermediate transfer belt 10 abut on each other according to the rotation of the photosensitive drum 6Y, the yellow toner image on the photosensitive drum is transferred onto the intermediate transfer belt by the primary transfer bias applied to the primary transfer roller 11Y.

When a region where the intermediate transfer belt 10 bears the yellow toner image is moved, a magenta toner image formed on the photosensitive drum 6M by the similar manner is transferred onto the yellow toner image on the intermediate transfer belt 10. Similarly, with the rotation of the intermediate transfer belt 10, a cyan toner image and a black toner image are superimposed on the yellow toner image and the magenta toner image in the primary transfer portion.

Therefore, the full-color toner image is formed on the intermediate transfer belt. After the toner image transfer, the toner remaining on the surface of the photosensitive drum is removed by a cleaner unit (not illustrated).

In parallel with the toner image forming operation, the pickup roller 2*b* delivers a sheet S accommodated in the sheet cassette 2*a*, the sheet S reaches a registration roller 4, and the registration roller 4 determines the timing of the sheet S and conveys the sheet S to the secondary transfer portion 12. For the sheet placed on the manual sheet feeding tray 3*a* of the manual sheet feeding portion 3, after the sheet is delivered by a manual sheet feeding roller (not illustrated), similarly the registration roller 4 determines the timing of the sheet S and conveys the sheet S to the secondary transfer portion 12.

In the secondary transfer portion 12, the toner images of four colors on the intermediate transfer belt are collectively transferred to the sheet S by the secondary transfer bias applied to the secondary transfer roller 12*a*. After the secondary transfer of the toner images to the sheet S, the toner remaining on the intermediate transfer belt is removed by the transfer belt cleaning device 10*a*, and the removed toner is recovered into a waste toner recovery container (not illustrated) disposed in a deep portion of the apparatus.

The sheet S to which the toner image is already transferred is conveyed to the fixing portion 16, and the unfixed toner image on the sheet is heated and fixed while passing through the nip formed by the heating roller 14 into which the heater 13 is incorporated and the pressure roller 15 that pressure-contacts the heating roller 14. Accordingly, the full-color print image is fixed onto the sheet as a permanent image. After the full-color print image is fixed as the permanent image, the sheet S is discharged to and stacked on the sheet stacking portion 20 by the pair of discharge rollers 18 provided in the sheet discharging apparatus 1D.

In the full-color laser printer 1 of the first embodiment, the images can be formed on both surfaces of the sheet. When the images are formed on both surfaces of the sheet, a conveying path is switched by a switching member 17 before the sheet S is discharged to the sheet stacking portion 20 by the pair of discharge rollers 18.

When the image is formed only in the single surface of the sheet S, the switching member 17 is located at a position where the switching member 17 does not obstruct the discharge of the sheet as illustrated in FIG. 1. On the other hand, the switching member 17 is turned downward when the images are formed on both the surfaces of the sheet S. When the switching member 17 is turned downward, the sheet conveying path is switched to a direction of a reversal conveying path R.

Therefore, after the sheet S reaches the pair of switch-back rollers 19 while being guided by the switching member 17, the sheet S is nipped and conveyed by the pair of switch-back rollers 19 and the sheet S is conveyed in the discharge direction. Then, the pair of switch-back rollers 19 is reversed after a predetermined time elapses. Along the way, the switching member 17 is returned to the position of FIG. 1.

The sheet S is conveyed to the registration roller 4 through the reversal conveying path R by the reversal rotation of the pair of switch-back rollers 19, the sheet S is conveyed again to the image forming portion 1B by the registration roller 4, and the image is formed in the second surface. In the sheet S in which the image is already formed in the second surface, the image is fixed by passing through fixing portion 16, and the sheet S is discharged to and stacked on the sheet stacking portion 20 by the pair of discharge rollers 18 which is of the sheet discharge portion.

Figure 2:
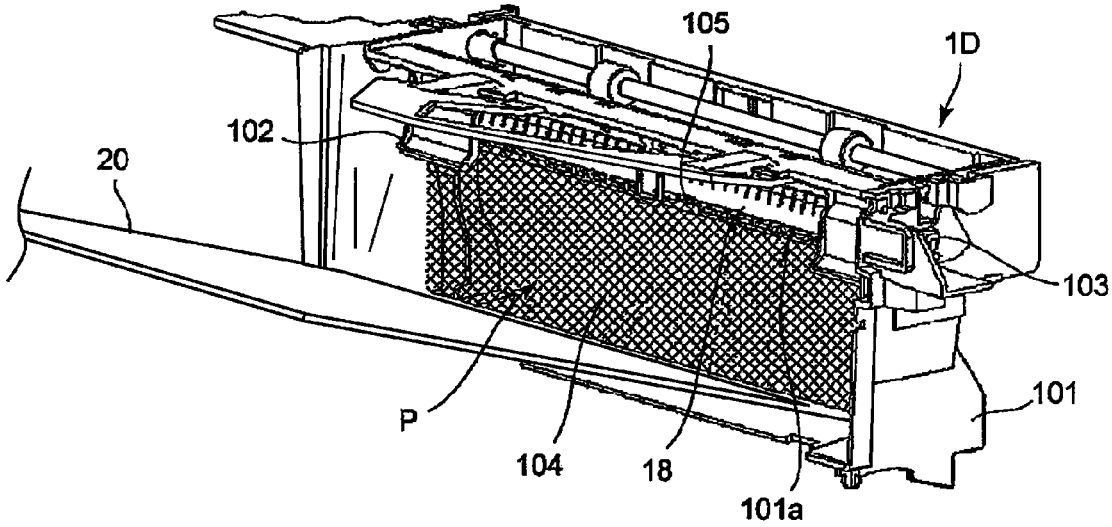
FIG. 2 is a perspective view illustrating a configuration of the sheet discharging apparatus.

FIG. 2 is a sectional view illustrating the configuration of the sheet discharging apparatus 1D of the full-color laser printer 1. In FIG. 2, the pair of discharge rollers 18, a full load detecting flag 102, a full load detecting sensor 103, and a sheet stacking wall 104 are provided in a discharge frame 101 of the printer main body 1A. The full load detecting flag 102 and the full load detecting sensor 103 detect a predetermined stacking height from a stacking surface of the sheets stacked on the sheet stacking portion 20, and the full load detecting flag 102 and the full load detecting sensor 103 determines whether or not the sheets are fully loaded.

In the first embodiment, the sheet discharging apparatus 1D includes the pair of discharge rollers 18, the full load detecting flag 102, the full load detecting sensor 103, and the sheet stacking wall 104. In the first embodiment, the full load detecting flag 102 which is of the pressing member is turnably retained by the discharge frame 101, and the full load detecting flag 102 is molded by a non-conductive resin.

The sheet stacking wall 104 regulates a tailing end position (position at upstream end in the sheet discharge direction) of the sheet stacked on the sheet stacking portion 20. The sheet stacking wall 104 is provided between the end on the upstream side in the sheet discharge direction of the sheet stacking portion 20 and the pair of discharge rollers 18. In the first embodiment, the sheet stacking wall 104 is provided between the location directly below the pair of discharge rollers 18 and the sheet stacking portion 20.

P denotes a tailing end regulating surface that is formed by the sheet stacking wall 104 and a rib 101*a*. The sheet stacking wall 104 constitutes a tailing end regulating portion that regulates the tailing end position of the sheet stacked on the sheet stacking portion 20. The rib 101*a* is located above the sheet stacking wall 104, and the rib 101*a* is extended in the width direction of the discharge frame 101. A projection 105 that is projected toward the downstream side in the sheet discharge direction from the tailing end regulating surface P is provided in an upper end portion of the central portion in the width direction of the tailing end regulating portion, that is, in the central portion in the width direction of the rib 101*a* in the first embodiment.

The end on the downstream side in the sheet discharge direction of the projection 105 is provided so as to be located on the upstream side in the sheet discharge direction rather than the downstream end in a circumferential surface of the pair of discharge rollers 18. Therefore, in the usual sheet discharge, the tailing end of the sheet discharged from the pair of discharge rollers 18 does not run on the projection 105. In the first embodiment, the central portion in the width direction of the tailing end regulating portion is matched with the center in the width direction of the sheet, in other words, the projection 105 is provided so as to be matched with the center in the width direction of the discharged sheet.

Figure 3:
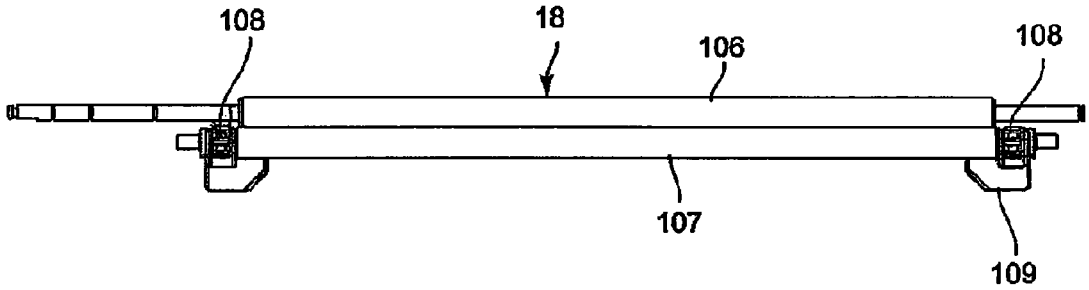
FIG. 3 illustrates a configuration of a pair of discharge rollers provided in the sheet discharging apparatus.

FIG. 3 illustrates a configuration of the pair of discharge rollers 18. As illustrated in FIG. 3, the pair of discharge rollers 18 includes a discharge driving roller 106 and a discharge driven roller 107 located on a print surface side. The discharge driving roller 106 and the discharge driven roller 107 have continuous roller surfaces so as to contact each other in the whole region in the width direction of the sheet. The rollers 106 and 107 are rotatably retained by the discharge frame 101. The sheet discharge portion may be a pair of belts not rollers as a pair of rotary members.

Figure 12:
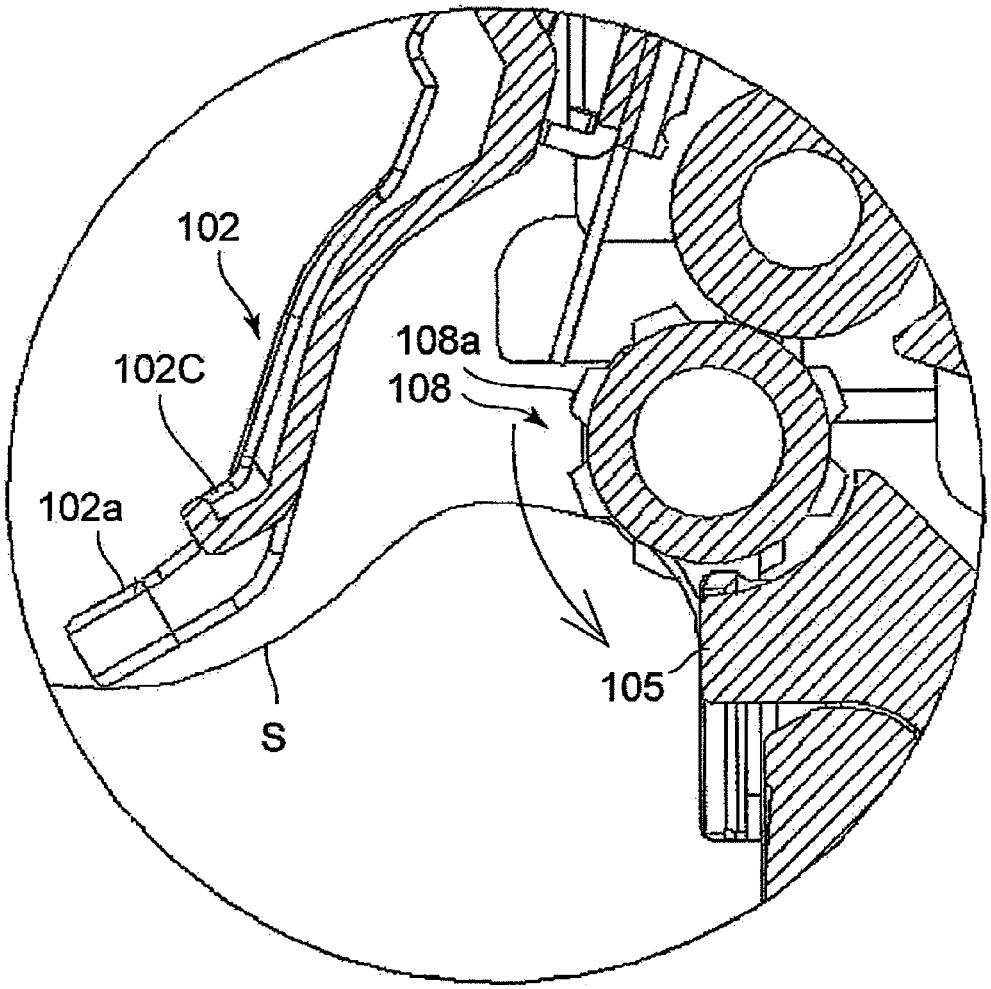
FIG. 12 illustrates a state until a tailing end portion of the sheet curled in the sheet discharge direction runs on an upper surface of the projection.
Figure 13:
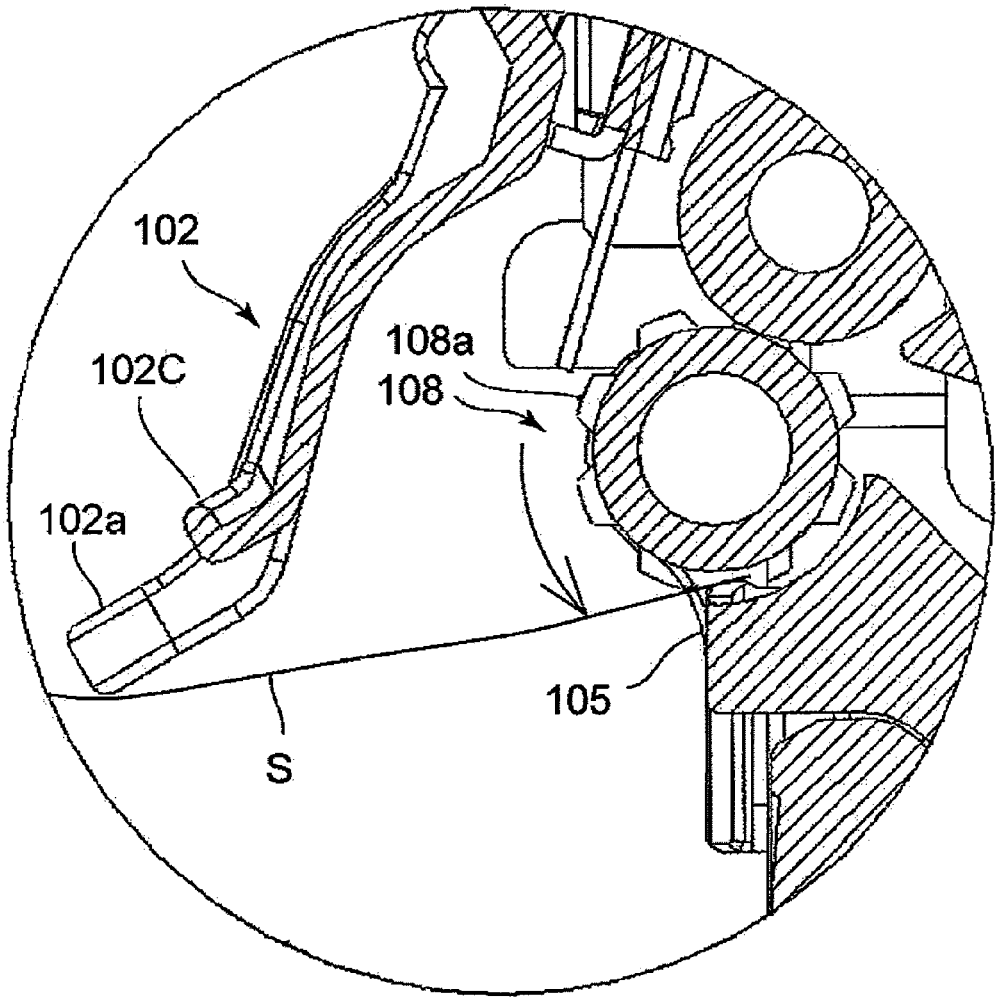
FIG. 13 is a first view illustrating a state in which the tailing end portion of the sheet curled in the sheet discharge direction runs on the upper surface of the projection.

Kick-out rollers 108 are fixed to both ends of the discharge driven roller 107, and the kick-out rollers 108 are used to kick out the sheet tailing end toward the sheet stacking portion 20 when the sheet is discharged. Irregularities are provided in the surface of the kick-out roller 108 as illustrated in FIGS. 12 and 13. Wrapping-around prevention walls 109 are provided at both ends of the discharge driven roller 107 illustrated in FIG. 6, and the wrapping-around prevention walls 109 prevent the sheet from invading into a gap G of FIG. 6 between the discharge driven roller 107 and the discharge frame 101.

Figure 4:
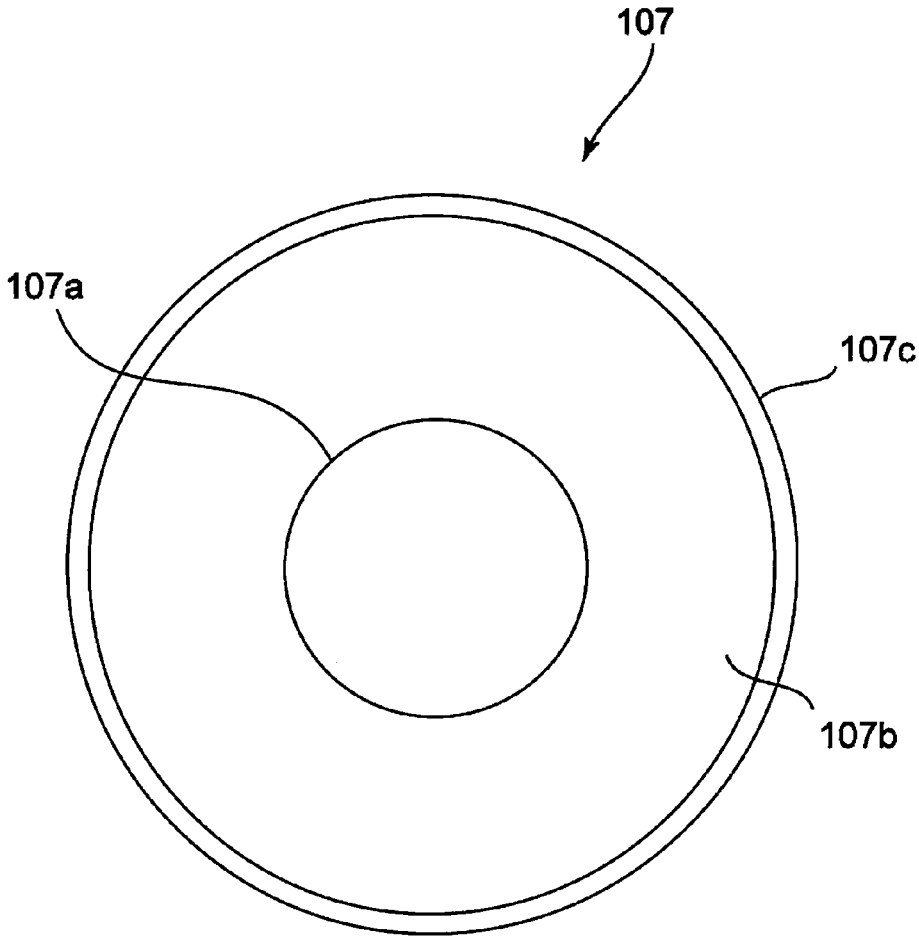
FIG. 4 illustrates a configuration of a discharge driven roller constituting the pair of discharge rollers.

As illustrated in FIG. 4, the discharge driven roller 107 formed by three layers, that is, a metal shaft 107*a*, a sponge 107*b*, and a superficial layer 107*c*. A tube (hereinafter referred to as PFA tube) made of a perfluoro alkyl vinyl ether co-polymer, that is, a so-called fluororesin is used as the superficial layer 107*c* in order to improve toner parting properties.

Figure 5:
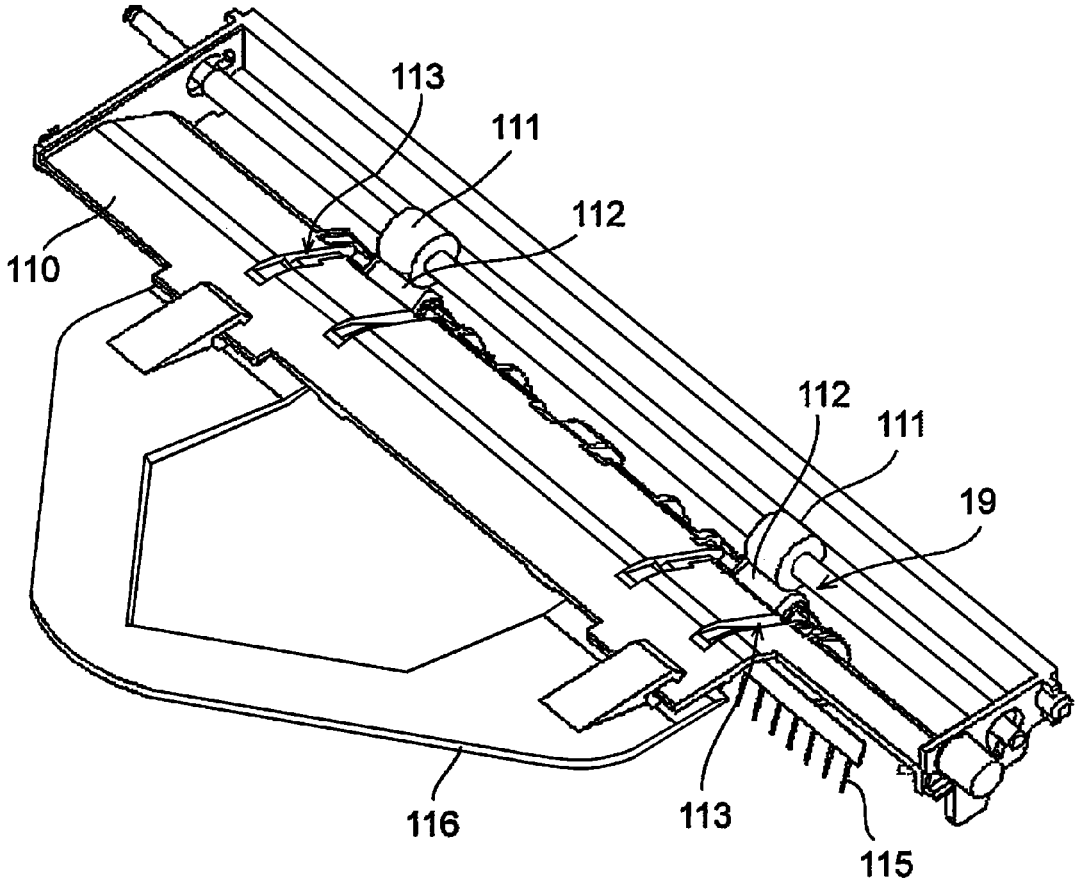
FIG. 5 illustrates a configuration of a switch-back portion provided in the full-color laser printer.

On the other hand, as illustrated in FIG. 5, a switch-back portion 23 including the pair of switch-back rollers 19 is provided above the pair of discharge rollers 18. Both ends of the pair of switch-back rollers 19 are retained by the switch-back guide 110 as illustrated in FIG. 5. The pair of switch-back rollers 19 includes a switch-back driving roller 111 and a switch-back driven roller 112. A nip pressure is ensured by pressing the center shaft of the switch-back driven roller 112 using a helical torsion spring 113.

A charge removal needle 115 adheres onto the downstream side in the sheet discharge direction of the switch-back guide 110, and a static charge of the sheet discharged from the pair of discharge rollers 18 is removed by the charge removal needle 115. A switch-back conveying guide 116 is provided on the downstream side in the sheet discharge direction of the switch-back guide 110. The switch-back conveying guide 116 prevents the sheet S from hanging to contact the sheet stacked on the sheet stacking portion 20 when the sheet S is reversely conveyed.

Figure 6:
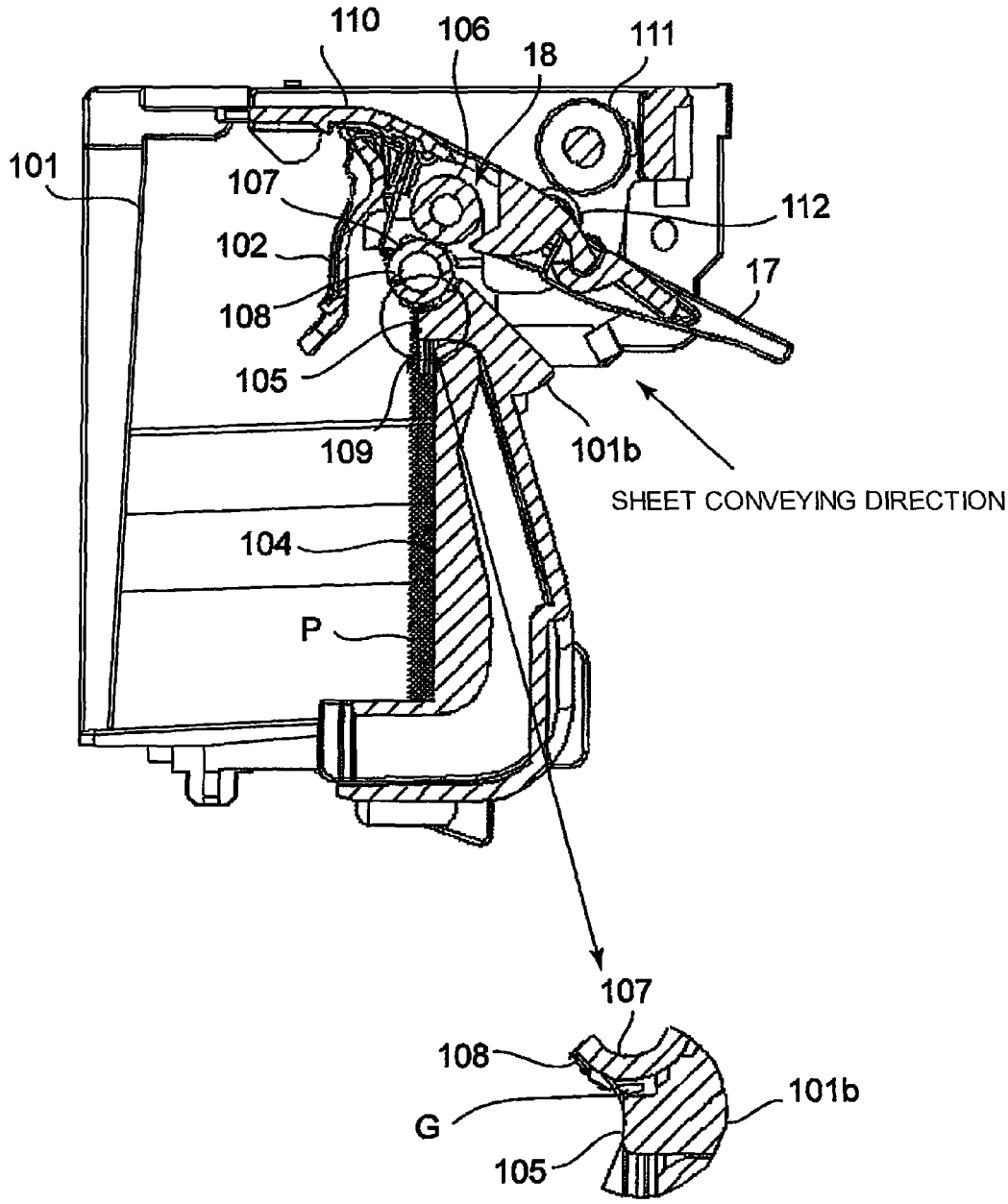
FIG. 6 is a sectional view illustrating the configuration of the sheet discharging apparatus.

FIG. 6 is a sectional view illustrating the configuration of the sheet discharging apparatus 1D. In FIG. 6, a rib 101*b* is provided in the discharge frame 101 in order to guide the sheet passing through the fixing portion 16 to the nip portion of the pair of discharge rollers 18. The sheet passing through the fixing portion 16 is conveyed to the nip portion of the pair of discharge rollers 18 along the switching member 17 whose both ends are supported by the rib 101*b* and the discharge frame 101, and the sheet is discharged to the sheet stacking portion 20 by the pair of discharge rollers 18.

When the sheet abuts on the full load detecting flag 102 in discharging the sheet to the sheet stacking portion 20, because the full load detecting flag 102 that is turnably retained in the discharge frame 101 is turned upward, the sheet is discharged to the sheet stacking portion 20 without damaging the sheet. After the sheet tailing end (end on the upstream side in the sheet discharge direction) passes through the pair of discharge rollers 18, the sheet is kicked out by the kick-out roller 108, and the sheet is stacked on the sheet stacking portion 20 without remaining in the nip portion of the pair of discharge rollers 18.

When the sheet is kicked out by the kick-out roller 108, the sheet is wrapped around by the kick-out roller 108, and the sheet possibly invades into the gap G between the discharge driven roller 107 and the rib 101*b* provided in the discharge frame 101.

Therefore, as described above, the wrapping-around prevention walls 109 are provided at both ends of the discharge driven roller 107, and the sheet that is nearly wrapped around by the kick-out roller 108 is prevented from invading into the gap G between the discharge driven roller 107 and the discharge frame 101. Accordingly, the paper jam caused by the sheet wrapped around the discharge driven roller 107 can be prevented.

In the case where the discharged sheet having the length in the width direction is shorter than an inside interval in the width direction of the wrapping-around prevention walls 109, the wrapping-around prevention walls 109 cannot prevent the sheet from invading into the gap G between the discharge driven roller 107 and the discharge frame 101.

Figure 7:
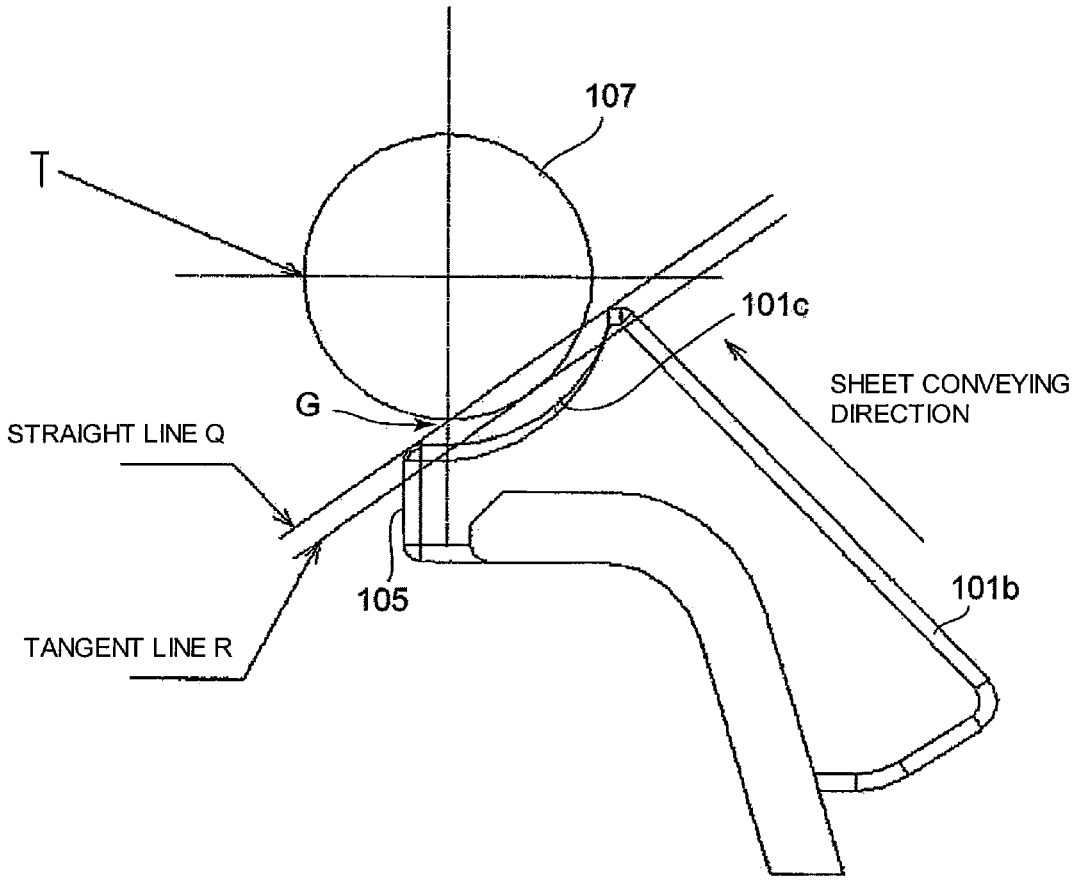
FIG. 7 illustrates a positional relationship among a projection provided in a sheet stacking wall, the discharge driven roller, and a rib in the sheet discharging apparatus.

In the first embodiment, as described above, the projection 105 is provided in the central portion of the rib 101*a* while projected toward the downstream side in the sheet discharge direction, and a positional relationship among the projection 105, the discharge driven roller 107, and the rib 101*b* is set as illustrated in FIG. 7. Therefore, the sheet is prevented from invading into the gap G between the discharge driven roller 107 and the discharge frame 101. A recess 101*c* is formed in a surface of the rib 101*b* located on the upstream side in the sheet discharge direction of the projection 105, and the recess 101*c* is curved downward to follow the discharge driven roller 107. The surface of the rib 101*b* faces the discharge driven roller 107 of the rib 101*b*.

A straight line Q connecting an upper surface end of the projection 105 and an upper end of the rib 101*b* whose surface facing the discharge driven roller 107 is curved downward is located on the opposite side to the sheet stacking portion 20 in relation to a tangent line R of the discharge driven roller 107 that is parallel to the straight line Q. That is, the discharge driven roller 107 which is of the lower roller of the pair of discharge rollers 18 partially invades the recess 101*c* that is curved downward below the discharge driven roller 107.

Because the superficial layer 107*c* (see FIG. 4) of the discharge driven roller 107 is formed by the PFA tube, the superficial layer 107*c* has an extremely small friction coefficient. Therefore, even if the sheet invades into the gap G, the discharge driven roller 107 cannot exert a conveying force enough to surmount the upper end of the rib 101*b* while curving the tailing end portion of the sheet. Accordingly, the small-size sheet can be prevented from invading into the gap G between the discharge driven roller 107 and the discharge frame 101.

The projection 105 provided in the central portion of the rib 101*a* is located on the upstream side of a downstream end T in the sheet discharge direction of the circumferential surface of the discharge driven roller 107. Therefore, in the usual sheet discharge, the tailing end of the sheet discharged from the pair of discharge rollers 18 does not run on the projection 105.

In the first embodiment, the projection 105 is provided in the central portion of the tailing end regulating portion. However, the invention is effective even in a configuration in which the center in the width direction of the discharged sheet is shifted from the central portion of the tailing end regulating portion. It is only necessary to provide the projection 105 between the pressing portions 102*a* and 102*b* that are located at both ends and abut on the discharged sheet, and it is not necessary that the projection 105 be matched with the center in the width direction of the discharged sheet.

Figure 8:
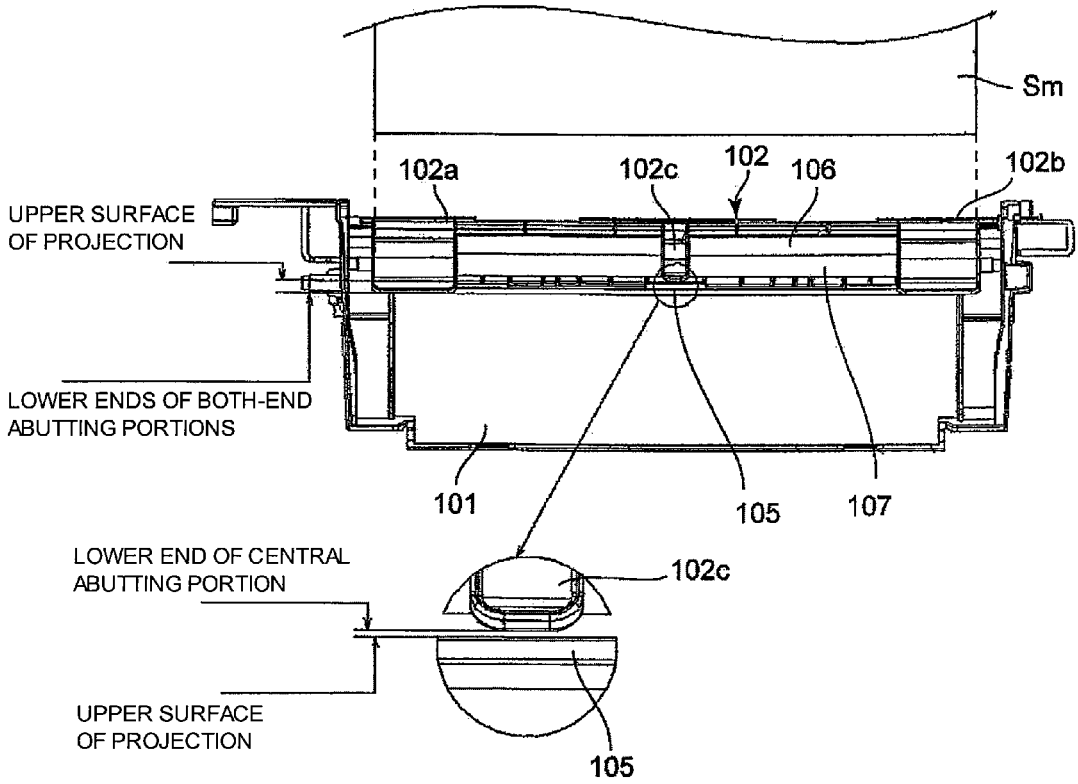
FIG. 8 illustrates a positional relationship between the projection and a full load detecting flag.

As illustrated in FIG. 8, the full load detecting flag 102 includes pressing portions 102*a* and 102*b* that are located at both ends of the full load detecting flag 102 and abut on the sheet and a pressing portion (hereinafter referred to as central pressing portion) 102*c* that is provided in the central portion according to the position of the projection 105. As described above, the sheet discharged by the pair of discharge rollers 18 presses the pressing portion 102*a* to 102*c*, thereby upwardly turning the full load detecting flag 102.

The full load detecting flag 102 presses the width direction portion near the tailing end of the sheet stacked on the sheet stacking portion 20 from above, the floating of the sheet tailing end caused by the curl is prevented, and the full load detecting flag 102 is turned upward with increasing the number of sheets stacked on the sheet stacking portion 20. When the full load detecting sensor 103 detects the upwardly turned full load detecting flag 102 which is of the pressing member, the control portion (not illustrated) determines that the sheets are fully loaded based on the detection result that the stacked sheets reach the predetermined stacking height.

In the first embodiment, the pressing portions 102*a* and 102*b* provided in both end portions of the full load detecting flag 102 are disposed near both end portions of a maximum sheet Sm pursuant to a specification of the full-color laser printer 1 so as to press the curl in the width direction of the sheet. The central pressing portion 102*c* is used to detect the predetermined stacking height of the sheet having the short length in the width direction.

In the case where the both-end pressing portions 102*a* and 102*b* hang by own weights, the lowest end positions of the pressing portions 102*a* and 102*b* are located below the upper surface of the projection 105, and the lowest end position of the central pressing portion 102*c* is located above the upper surface of the projection 105.

The state in which the sheets are stacked on the sheet stacking portion 20 in the full-color laser printer provided with the sheet discharging apparatus 1D will be described below.

Figure 9:
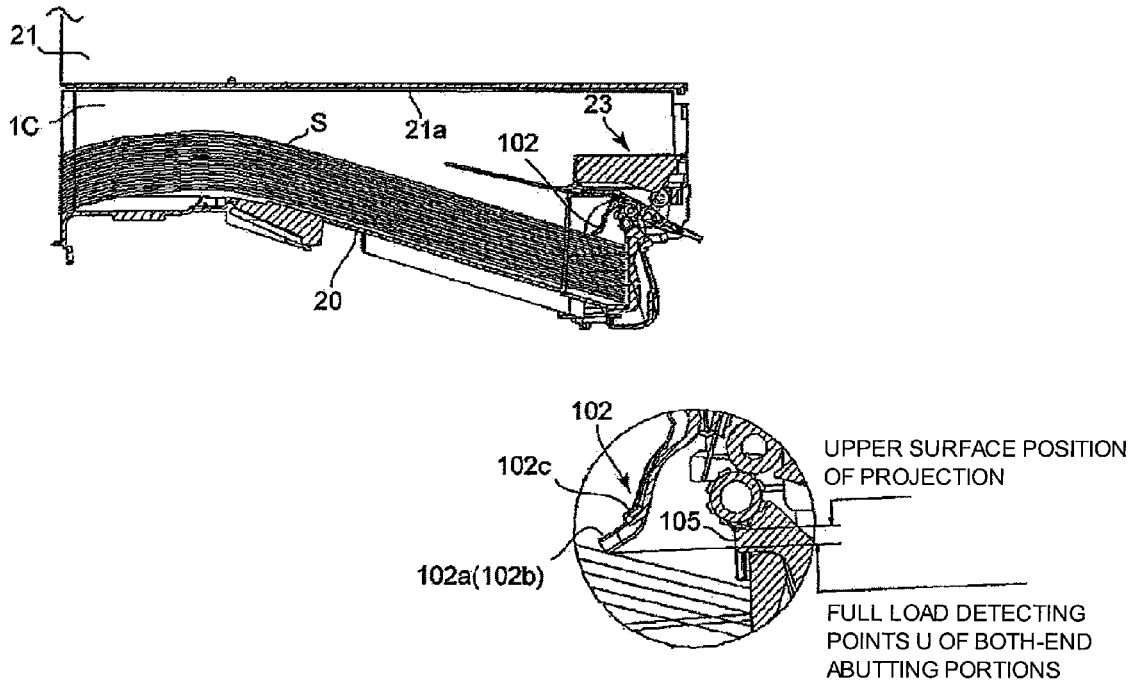
FIG. 9 illustrates a state in which slightly curled sheets are stacked in the full-color laser printer.

In the case where the sheet is slightly curled, as illustrated in FIG. 9, the predetermined stacking height of the sheets S stacked on the sheet stacking portion 20 can be detected before the sheet S contacts a lower surface 21*a* of the image reading apparatus 21. At this point, a full load detecting point U in the full load detecting flag 102 including the pressing portions 102*a* and 102*b* at both ends thereof is located below the upper surface of the projection 105. The full load detecting point U is provided on the downstream side in the sheet discharge direction of the tailing end regulating surface P.

That is, the projection 105 is provided at a predetermined height above the maximum stacking height so as not to obstruct the discharge of the sheet having no curl.

Figure 10A:
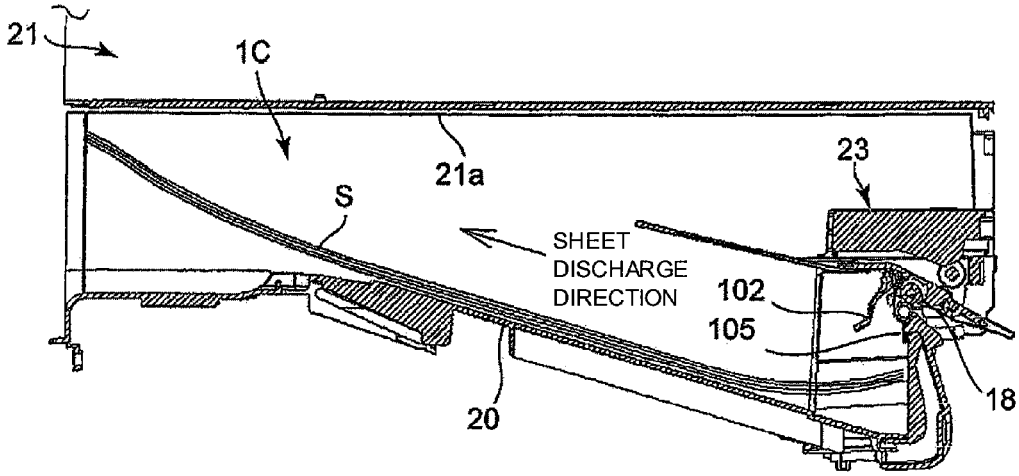
FIGS. 10A and 10B illustrate a state in which the sheets curled in the sheet discharge direction are stacked in the full-color laser printer.
Figure 10B:
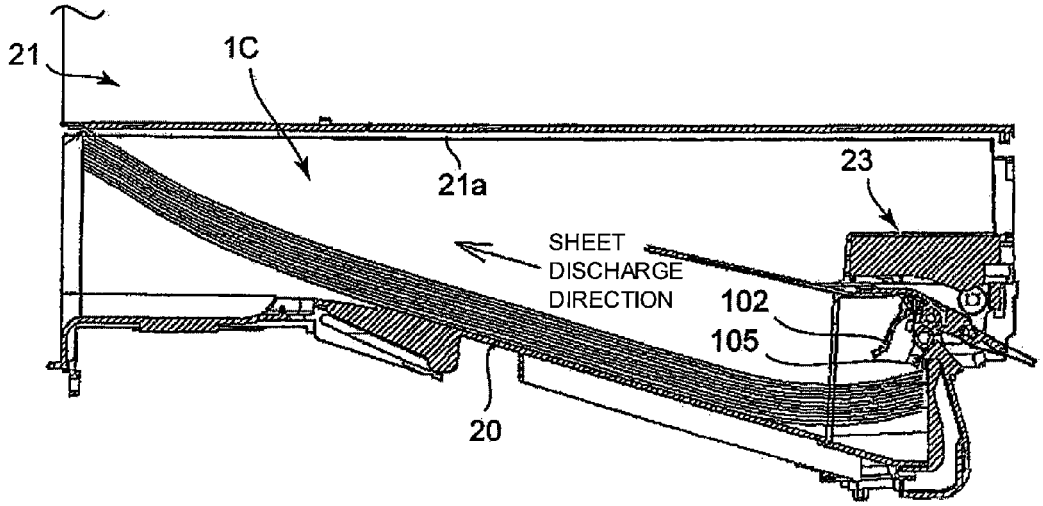

On the other hand, in the case where the discharged sheet S is curled in the sheet discharge direction, as illustrated in FIG. 10A, the sheets are stacked with no problem in the small numbers of sheets. However, when the number of stacked sheets is gradually increased, as illustrated in FIG. 10B, the sheet leading end abuts on the lower surface 21*a* of the image reading apparatus 21 before the full load detecting flag 102 detects the fully loaded state.

Figure 11:
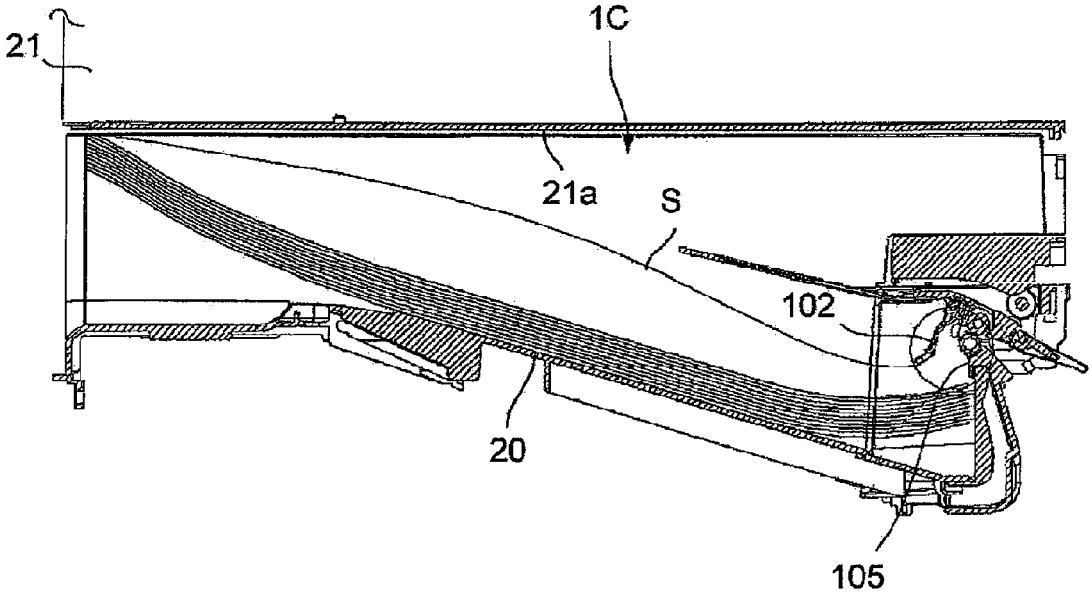
FIG. 11 illustrates a state in which the sheet curled in the sheet discharge direction collides with a bottom surface in the full-color laser printer.

When the sheet leading end abuts on the image reading apparatus 21, the sheets S that has nowhere to go in the sheet discharge direction is curled, and the tailing end of the sheet S abuts on the kick-out roller 108 as illustrated in FIG. 11. Then, as illustrated in FIG. 12, the sheet tailing end is moved downward by irregularities 108*a* provided in the surface of the kick-out roller 108 rotated in an arrow direction.

Figure 14:
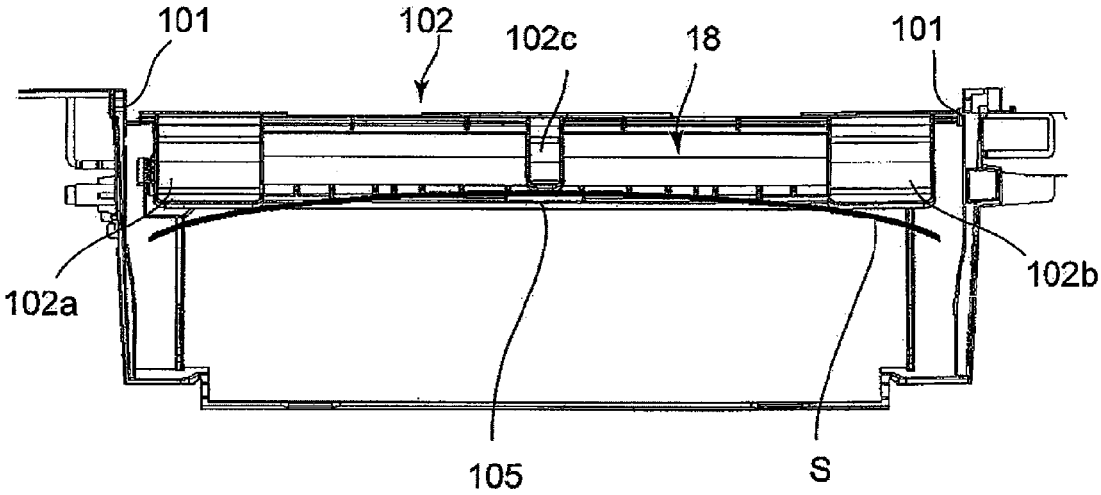
FIG. 14 is a second view illustrating a state in which the tailing end portion of the sheet curled in the sheet discharge direction runs on the upper surface of the projection.

At this pint, because the sheet leading end still abuts on the lower surface 21*a,* the sheet tailing end portion (end on the upstream side in the sheet discharge direction) is not moved onto the side of the sheet stacking portion 20, but the sheet tailing end portion is supported while running on the upper surface which is of the sheet support portion of the projection 105 as illustrated in FIG. 13. Because the lower end positions of the both-end pressing portions 102*a* and 102*b* are located above the upper surface of the projection 105, the pressing portions 102*a* and 102*b* abut on the neighborhood of the tailing end of the sheet S from above as illustrated in FIG. 14. FIG. 14 illustrates the state of FIG. 13 when viewed from a front face.

Because the position of the central pressing portion 102*c* is located above the upper surface of the projection 105, the central pressing portion 102*c* does not run on the sheet. This phenomenon becomes significant when the sheet leading end abuts on the lower surface 21*a* of the image reading apparatus 21, and the phenomenon is also generated when the curl in the sheet discharge direction is simply increased to float the tailing end of the sheet S above the upper surface of the projection 105.

As a result, as illustrated in FIG. 14, in the neighborhood of the sheet tailing end, the central portion in the width direction runs on the projection 105, both end portions are pushed downward by the pressing portions 102*a* and 102*b*. That is, in the first embodiment, the sheet tailing end is formed into a shape in which the central portion is bent upward by the both-end pressing portions 102*a* and 102*b* and the upper surface of the projection 105.

The sheet tailing end is formed into the shape to increase the rigidity of the sheet, and the sheet tailing end does not invade into the space between the full load detecting flag 102 and the pair of discharge rollers 18. Therefore, the collision of the next discharged sheet with the sheet S and the paper jam caused by the collision can be prevented in the sheet curled in the sheet discharge direction.

The sheet charging can be cited as one of other factors that lower the sheet stacking property. The sheet discharged from the discharge port is charged in passing through each portion in the image forming apparatus. Therefore, when the charged sheet is stacked on the sheet stacking portion, the sheet charged in the same polarity are repulsive and a stacking fault is generated.

The sheet floating caused by the sheet charging generates the sheet push-out, and the sheet adheres to the pressing member charge in the opposite-polarity to that of the sheet, which results in the problem of the paper jam. The adhesion of the sheet to the pressing member tends to significantly emerge in the low-temperature, low-humidity environment.

In the recent image forming apparatus, a sheet conveying speed is enhanced, and the static charge amount generated by sliding of the sheet passage is increased. Therefore, the static charge is not completely removed in the continuous and massive print, the sheet is gradually floated by the charging, and a possibility of generating the stacking fault is enhanced.

The invention is effectively applied to the sheet whose static charge is not completely removed, and the sheet can properly be discharged to and stacked on the sheet stacking portion by applying the invention.

The prevention of the sheet collision or the paper jam can prevent the sheet scattering in the discharge space portion and the waste of the sheet, and the user friendly full-color laser printer 1 can be realized.

Because the rigidity of the sheet is increased when the sheet tailing end is formed into the shape in which the central portion is curved upward as illustrated in FIG. 14, the subsequent sheet is stacked on the sheet after that when the subsequent sheet is discharged. As described above, because the lower end of the central pressing portion 102*c* is located above the upper surface of the projection 105, the sheet shape formed by the lower ends of the both-end pressing portions 102*a* and 102*b* and the upper surface of the projection 105 is not broken down.

On the other hand, when the subsequent sheets are stacked, the subsequent sheets press the full load detecting flag 102 to gradually turn upward the full load detecting flag. As a result, the full load detecting sensor 103 detects the full load detecting flag 102, thereby detecting the fully loaded state of the sheets. When the fully loaded state of the sheets is detected, the discharge of the sheet to the sheet stacking portion 20 is stopped to previously prevent the overload and the generation of the paper jam.

In the case of the small-size sheet in which the sheet leading end does not abut on the image reading apparatus 21, the sheet can be pressed by the central pressing portion 102*c* of the full load detecting flag 102. The subsequent sheets press the central pressing portion 102*c* to gradually upward turn the full load detecting flag 102, thereby detecting the fully loaded state of the sheets.

Thus, the tailing end portion of the discharged sheet is supported by the projection 105, and both end portions of the sheet is pressed down below the upper surface of the projection 105 by the pressing portions 102*a* and 102*b* located at both ends of the full load detecting flag 102, which allows the discharged sheet to be bent. Therefore, even the curled or charged sheet can properly be discharged to and stacked on the sheet stacking portion.

As described above, because the full load detecting flag 102 is molded using not the conductive resin (material) but the non-conductive resin, it is not necessary to provide a ground mechanism. Therefore, the simple and low-cost sheet discharging apparatus 1D can be realized.

The pair of discharge rollers 18 has the continuous roller surface that is formed in straight in a longitudinal direction, so that the generation of the rib trace or roller trace can be prevented in the image. In the first embodiment, the sheet is bent after the sheet is discharged, so that the generation of the rib trace or roller trace can be prevented in the image.

In the full-color laser printer 1, it is necessary that a temperature at which the toner is fixed be raised with increasing image forming speed. In the high-speed full-color laser printer, when the fixing temperature is high, and when cooling is insufficiently performed due to a large amount of toner existing on the sheet, the toner on a sheet in the stacked sheets adheres to the toner on another sheet to generate peel-off of the image. Therefore, the sheet discharged to the sheet stacking portion is cooled by the air in order to solve the adhesion.

A second embodiment of the invention in which the sheet discharged to the sheet stacking portion is cooled by the air will be described below.

Figure 15:
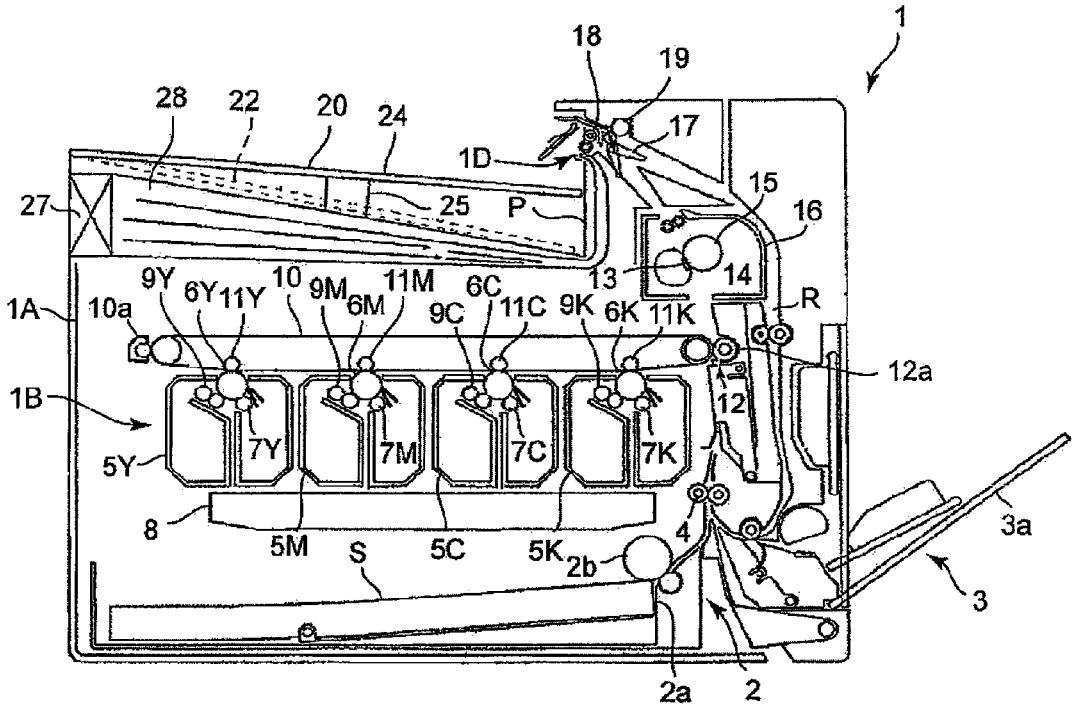
FIG. 15 illustrates an entire configuration of a full-color laser printer which is of an example of an image forming apparatus provided with a sheet discharging apparatus according to a second embodiment of the present invention.

FIG. 15 illustrates an entire configuration of a full-color laser printer which is of an example of an image forming apparatus provided with a sheet discharging apparatus according to a second embodiment of the invention. In FIG. 15, the same reference numeral as that of FIG. 1 designates the same or equivalent portion.

Referring to FIG. 15, a turning tray 24 constituting the sheet stacking portion is turned about the downstream end in the sheet discharge direction, and a spring 25 presses the turning tray 24 from below. As the sheet stacking amount is increased, the tailing end side of the discharged sheet is inclined downward.

Figure 16:
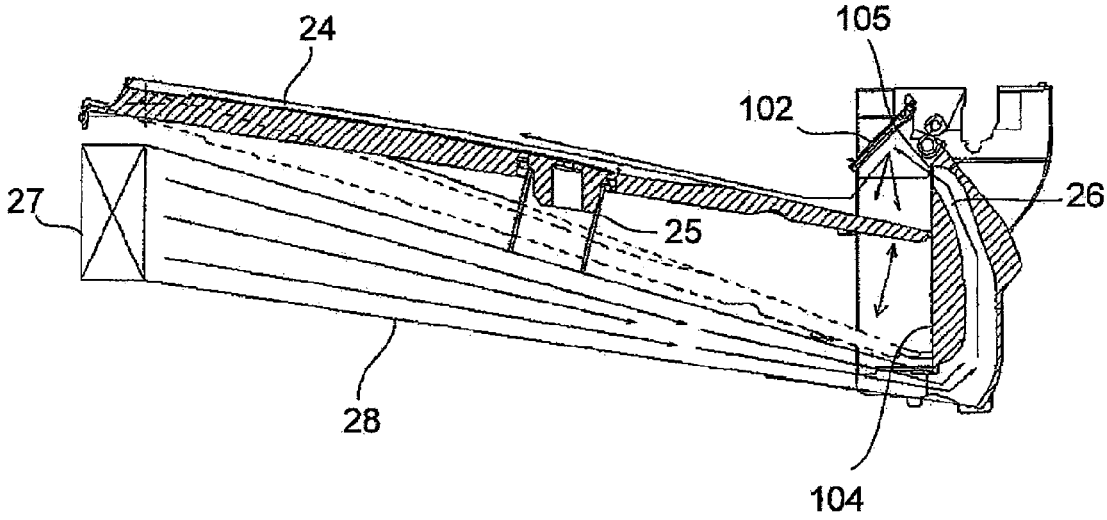
FIG. 16 is a sectional view illustrating a configuration of the sheet discharging apparatus.

A duct 28 is provided below the turning tray 24, and a fan 27 blows the air in the duct 28. As illustrated in FIG. 16, a blowout port 26 which is of the air blowout portion is provided between the sheet stacking wall 104 and the projection 105 in order to blow out the air toward the full load detecting flag 102.

The air blown from the fan 27 passes through the duct 28 toward the blowout port 26 that is provided between the sheet stacking wall 104 and the projection 105 in order to blow out the air toward the full load detecting flag 102 as illustrated in FIG. 16.

Figure 17:
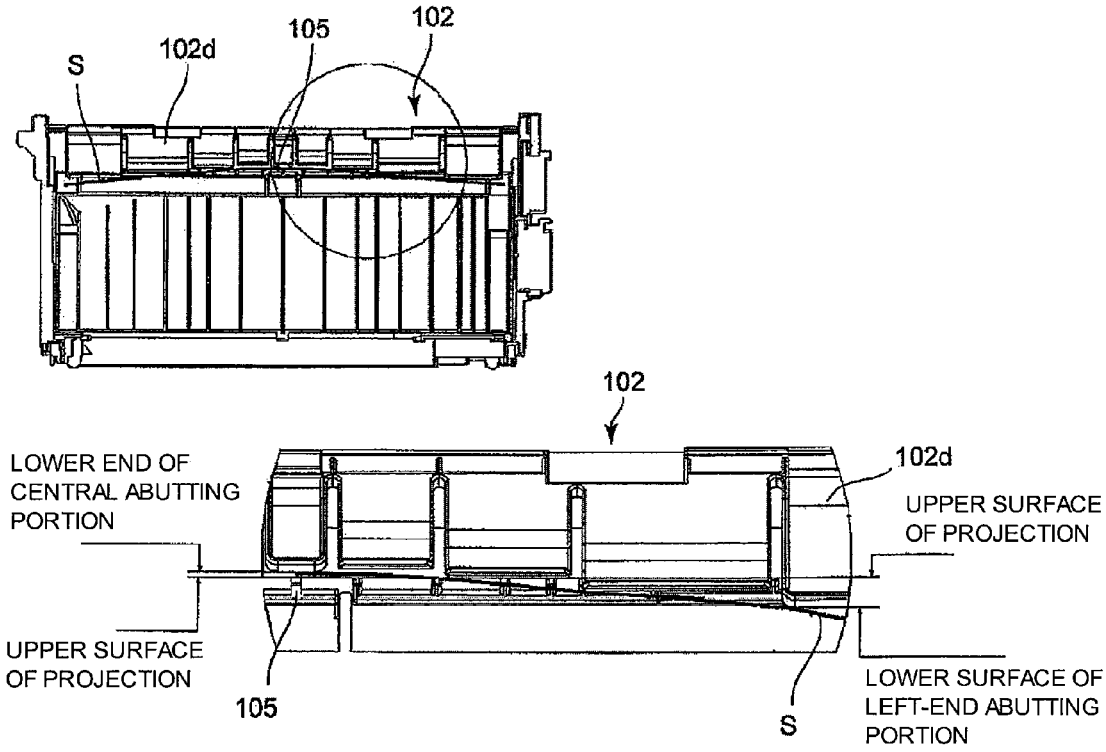
FIG. 17 illustrates a configuration of a full load detecting flag provided in the sheet discharging apparatus.
Figure 18:
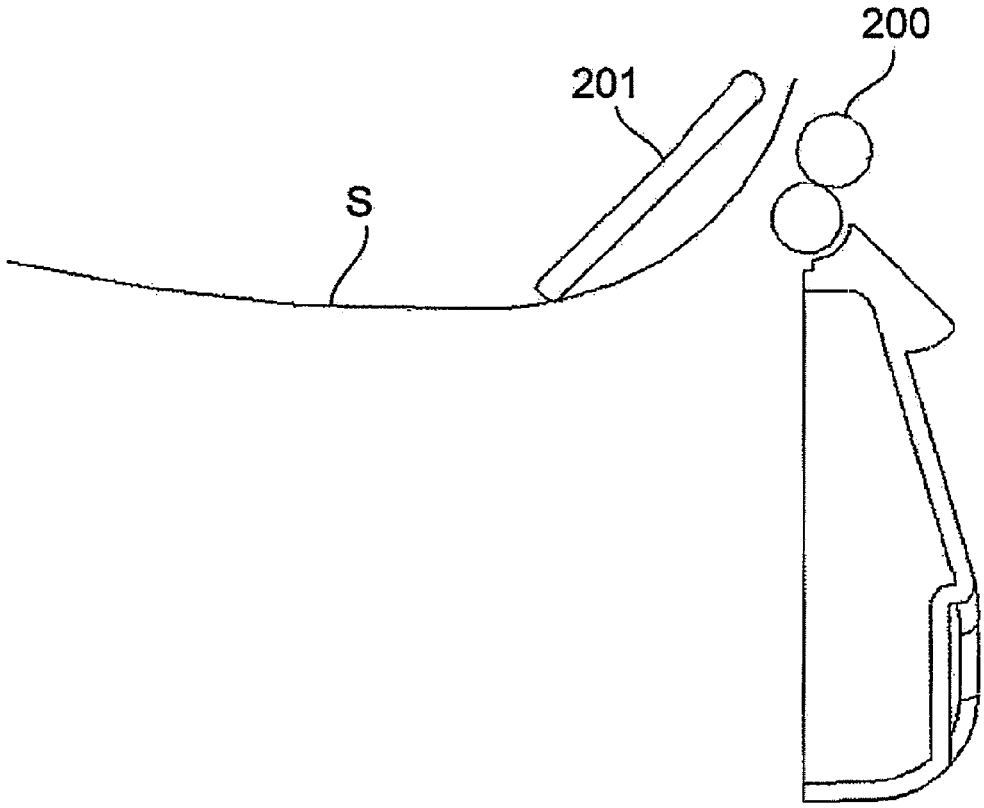
FIG. 18 PRIOR ART
FIG. 18 illustrates a state in which a tailing end of a sheet curled in the sheet discharge direction hides between a pressing member and a pair of discharge rollers in a conventional image forming apparatus.

In the second embodiment, as illustrated in FIG. 17, the full load detecting flag 102 has a pressing portion 102*d* in the whole region in the width direction, and the air is blown to the pressing portion 102*d* from the blowout port 26. When the air is blown to the pressing portion 102*d*, the air direction is changed, the air is orientated toward the neighborhood of the tailing end of the sheet discharged onto the turning tray, and the air flows in the sheet discharge direction along the upper surface of the sheet S, thereby cooling the whole surface of the sheet.

Thus, in the second embodiment, the pressing portion 102*d* of the full load detecting flag 102 is provided in the whole region in the width direction, the sheet stacked on the turning tray 24 can efficiently be cooled. Similarly to the first embodiment, the sheet cooling configuration of the second embodiment exerts the effect in the image forming apparatus in which the discharge space portion 1C is provided between the upper surface of the printer main body 1A and the image reading apparatus 21.

In the second embodiment, in the pressing portion 102*d* provided in the whole region in the width direction, as illustrated in FIG. 17, the lower end in the central portion of the pressing portion 102*d* is located above the upper surface of the projection 105, and the lower ends of the both end portions in the width direction of the pressing portion 102*d* are located below the upper surface of the projection 105. Therefore, similarly to the first embodiment, the collision of the next discharged sheet with the sheet S or the paper jam caused by the collision can be prevented, even if the sheet S is curled in the sheet discharge direction, or even if the static charge is not completely removed in the sheet S.

In the above embodiments, the full-color laser printer provided with the plurality of photosensitive drums is described as an example of the image forming apparatus. However, the present invention is not limited to the full-color laser printer. For example, the invention can be applied to a monochrome copying machine or a printer which includes one photosensitive drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-018723, filed Jan. 30, 2008, and No. 2009-009897, filed Jan. 20, 2009, which are hereby incorporated by reference herein in their entirety.

What is claimed is:

1. A sheet discharging apparatus, comprising:

a sheet discharge portion which discharges a sheet;

a sheet stacking portion on which the sheet discharged from the sheet discharge portion is stacked;

a tailing end regulating portion which has a tailing end regulating surface, the tailing end regulating surface regulating an upstream end position in a sheet discharge direction of the sheet stacked on the sheet stacking portion;

a pressing member which has pressing portions, the pressing portions pressing the discharged sheet; and a projection which is projected from the tailing end regulating surface toward a downstream side in the sheet discharge direction, the projection being provided between the pressing portions such that an upper surface of the projection locates above a lowest end position of the pressing portion, wherein when an end portion, on the upstream side in the sheet discharge direction, of the sheet discharged to the sheet stacking portion is supported by the projection, the pressing portions of the pressing member press down the sheet on the both sides of the projection.

2. The sheet discharging apparatus according to claim 1, wherein the projection is projected such that an end on the downstream side in the sheet discharge direction of the projection is located on the upstream side in the sheet discharge direction rather than an end on the downstream side in the sheet discharge direction of the sheet discharge portion.

3. The sheet discharging apparatus according to claim 1, wherein the pressing member is formed so as to be turned as the number of sheets stacked on the sheet stacking portion is increased, and the pressing member includes a detecting member which detects a predetermined stacking height of the sheets based on the turn of the pressing member.

4. The sheet discharging apparatus according to claim 3, wherein the projection is provided at a position that is higher than the predetermined stacking height.

5. The sheet discharging apparatus according to claim 1, wherein at least one of the a pressing portions is located at a position corresponding to the projection, and a lower end position of the pressing portion is set above the upper surface of the projection.

6. The sheet discharging apparatus according to claim 1, wherein the pressing member is made of a non-conductive material.

7. The sheet discharging apparatus according to claim 1, comprising an air blowout portion which blows out air toward the pressing member, wherein the pressing member orientates the air blown out by air blowout portion toward the sheets stacked on the sheet stacking portion.

8. The sheet discharging apparatus according to claim 1, wherein the sheet discharge portion is formed by a pair of discharge rollers including a continuous roller surface.

9. The sheet discharging apparatus according to claim 8, wherein a recess is provided on the upstream side in the sheet discharge direction of the projection, a lower roller of the pair of discharge rollers intruding into the recess.

10. An image forming apparatus comprising:

an image forming portion which forms an image; and the sheet discharging apparatus according to claim 1 which discharges a sheet, the image being formed in the sheet by the image forming portion.

11. An image forming apparatus comprising:

an image reading apparatus which reads image information on an original;

an image forming portion which is provided below the image reading apparatus to form an image based on the read image information;

a discharge space portion which is provided between the image reading apparatus and the image forming portion to discharge a sheet; and the sheet discharging apparatus according to claim 1 which discharges the sheet in which the image is formed by the image forming portion to the discharge space portion.

12. A sheet discharging apparatus, comprising:

a pair of discharge rotary members which discharges a sheet;

a sheet stacking portion on which the sheet discharged from the pair of rotary members is stacked;

a tailing end regulating portion which has a tailing end regulating surface, the tailing end regulating surface regulating an upstream end position in a sheet discharge direction of the sheet stacked on the sheet stacking portion;

a projection which is projected from the tailing end regulating surface toward a downstream side in the sheet discharge direction, the projection being projected such that an end, on the downstream side in the sheet discharge direction, of the projection is located on the upstream side in the sheet discharge direction rather than an end on the downstream side in the sheet discharge direction of the pair of discharge rotary members; and a pressing member which has pressing portions, the pressing portions pressing down a sheet supported by the projection on the both sides of the projection.

13. The sheet discharging apparatus according to claim 12, wherein the pressing member is formed so as to be turned as the number of sheets stacked on the sheet stacking portion is increased, and the pressing member includes a detecting member which detects a predetermined stacking height of the sheets based on the turn of the pressing member.

14. The sheet discharging apparatus according to claim 13, wherein the projection is provided at a position that is higher than the predetermined stacking height.

15. The sheet discharging apparatus according to claim 12, wherein at least one of the a pressing portions is located at a position corresponding to the projection, and a lower end position of the pressing portion is set above the upper surface of the projection.

16. The sheet discharging apparatus according to claim 12, wherein the pressing member is made of a non-conductive material.

17. The sheet discharging apparatus according to claim 12, comprising an air blowout portion which blows out air toward the pressing member, wherein the pressing member orientates the air blown out by air blowout portion toward the sheets stacked on the sheet stacking portion.

18. The sheet discharging apparatus according to claim 12, wherein the sheet discharge portion is formed by a pair of discharge rollers including a continuous roller surface.

19. The sheet discharging apparatus according to claim 18, wherein a recess is provided on the upstream side in the sheet discharge direction of the projection, a lower roller of the pair of discharge rollers intruding into the recess.

20. An image forming apparatus comprising:

an image forming portion which forms an image; and the sheet discharging apparatus according to claim 12 which discharges a sheet, the image being formed in the sheet by the image forming portion.

21. An image forming apparatus comprising:

an image reading apparatus which reads image information on an original;

an image forming portion which is provided below the image reading apparatus to form an image based on the read image information;

a discharge space portion which is provided between the image reading apparatus and the image forming portion to discharge a sheet; and the sheet discharging apparatus according to claim 12 which discharges the sheet in which the image is formed by the image forming portion to the discharge space portion.

* * * * *